US007854258B2

(12) United States Patent
Sheiretov et al.

(10) Patent No.: US 7,854,258 B2
(45) Date of Patent: Dec. 21, 2010

(54) SELF-ANCHORING DEVICE WITH FORCE AMPLIFICATION

(75) Inventors: Todor K. Sheiretov, Houston, TX (US); Dwight C. Chilcoat, Fresno, TX (US); Robin A. Ewan, Stafford, TX (US); Carl J Roy, Richmond, TX (US); Matthew Billingham, Houston, TX (US); Franz Aguirre, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/396,936

(22) Filed: Mar. 3, 2009

(65) Prior Publication Data

US 2009/0159269 A1 Jun. 25, 2009

Related U.S. Application Data

(63) Continuation of application No. 11/610,143, filed on Dec. 13, 2006, now Pat. No. 7,516,782.

(60) Provisional application No. 60/771,659, filed on Feb. 9, 2006.

(51) Int. Cl.
*E21B 31/12* (2006.01)
*E21B 31/00* (2006.01)

(52) U.S. Cl. ..... 166/98; 166/301

(58) Field of Classification Search ..... 166/301, 166/98, 178, 382, 206
See application file for complete search history.

(56) References Cited

U.S. PATENT DOCUMENTS 6,241,031 B1 6/2001 Beaufort
6,273,189 B1 8/2001 Gissler
6,347,674 B1 2/2002 Bloom
6,427,786 B2 8/2002 Beaufort
6,464,003 B2 10/2002 Bloom
6,467,557 B1 10/2002 Krueger
6,478,097 B2 11/2002 Bloom
6,640,894 B2 11/2003 Bloom
6,679,341 B2 1/2004 Bloom
6,715,559 B2 4/2004 Bloom
6,745,854 B2 6/2004 Bloom
6,868,906 B1 3/2005 Vail
6,938,708 B2 9/2005 Bloom
7,048,047 B2 5/2006 Bloom (Continued)

FOREIGN PATENT DOCUMENTS

EP 1344893 9/2003

(Continued)

*Primary Examiner*—Daniel P Stephenson
*Assistant Examiner*—Brad Harcourt
(74) *Attorney, Agent, or Firm*—Michael Flynn; David Hofman; Jody Destefanis

(57) ABSTRACT

A downhole tool is provided that includes a grip assembly for contacting a well formation. The grip assembly includes a gripper body; and a centralizer that is attached to and radially expandable with respect to the gripper body and that has a geometry which is lockable by a locking device. The grip assembly also includes a force amplifier in force transmitting relation with the centralizer, wherein the force amplifier transfers a force in a first direction to a much larger force in a second direction when the centralizer is locked by the locking device.

16 Claims, 10 Drawing Sheets

U.S. PATENT DOCUMENTS

| | | | | |
|---|---|---|---|---|
| 7,080,700 | B2 | 7/2006 | Bloom | |
| 7,080,701 | B2 | 7/2006 | Bloom | |
| 7,121,364 | B2 | 10/2006 | Mock | |
| 7,174,974 | B2 | 2/2007 | Bloom | |
| 7,252,143 | B2 | 8/2007 | Sellers | |
| 2002/0029908 | A1 | 3/2002 | Bloom | |
| 2002/0104686 | A1 | 8/2002 | Bloom | |
| 2003/0116356 | A1 | 6/2003 | Bloom | |
| 2003/0121703 | A1 | 7/2003 | Bloom | |
| 2003/0173076 | A1 | 9/2003 | Sheiretov | |
| 2003/0188875 | A1 | 10/2003 | Bloom | |
| 2004/0245018 | A1 | 12/2004 | Bloom | |
| 2005/0082055 | A1 | 4/2005 | Bloom | |
| 2005/0145415 | A1 * | 7/2005 | Doering et al. | 175/24 |
| 2005/0247488 | A1 | 11/2005 | Mock | |
| 2005/0252686 | A1 | 11/2005 | Bloom | |
| 2006/0196694 | A1 | 9/2006 | Bloom | |
| 2006/0196696 | A1 | 9/2006 | Bloom | |

FOREIGN PATENT DOCUMENTS

| | | |
|---|---|---|
| GB | 2346908 | 8/2000 |
| GB | 2351308 | 12/2000 |
| GB | 2362405 | 11/2001 |
| GB | 2370056 | 6/2002 |
| GB | 2378468 | 2/2003 |
| GB | 2378469 | 2/2003 |
| GB | 2380755 | 4/2003 |
| GB | 2389135 | 12/2003 |
| GB | 2413816 | 11/2005 |
| GB | 2414499 | 11/2005 |
| WO | 9510683 | 4/1995 |
| WO | 0036266 | 6/2000 |
| WO | 0046481 | 8/2000 |
| WO | 0109478 | 2/2001 |
| WO | 0244509 | 6/2002 |
| WO | 2004072433 | 8/2004 |
| WO | 2005090739 | 9/2005 |

* cited by examiner

SELF-ANCHORING DEVICE WITH FORCE AMPLIFICATION

CROSS-REFERENCE TO RELATED APPLICATION

This application is a continuation of prior U.S. patent application Ser. No. 11/610,143, filed on Dec. 13, 2006 now U.S. Pat. No. 7,516,782; which in turn is entitled to the benefit of, and claims priority to U.S. Provisional Patent Application Ser. No. 60/771,659, filed on Feb. 9, 2006, the entire disclosures of each of which are incorporated herein by reference.

FIELD OF THE INVENTION

The present invention relates generally to a grip assembly that uses a force applied in one direction to generate a much larger force in another direction, the latter being used to anchor the grip assembly with respect to its surroundings or to create traction. More specifically, the invention relates to tools that may be used to convey items in a well or perform various mechanical services in a wellbore.

BACKGROUND OF INVENTION

Once a well is drilled, it is common to log certain sections of it with electrical instruments. These instruments are sometimes referred to as "wireline" instruments, as they communicate with the logging unit at the surface of the well through an electrical wire or cable with which they are deployed. In vertical wells, often the instruments are simply lowered down the well on the logging cable. In horizontal or highly deviated wells, however, gravity is frequently insufficient to move the instruments to the depths to be logged. In these situations, it is necessary to use alternative conveyance methods. One such method is based on the use of downhole tractor tools that run on power supplied through the logging cable and pull or push other logging tools along the well.

Downhole tractors that convey logging tools along a well are commercially available. These downhole tractors use various means to generate the traction necessary to convey logging tools. Some designs employ powered wheels that are forced against the well wall by hydraulic or mechanical actuators. Others use hydraulically actuated linkages to anchor part of the tool against the wellbore wall and then use linear actuators to move the rest of the tool with respect to the anchored part.

A common feature of all the above systems is that they use "active" grips to generate the radial forces that push the wheels or linkages against the well wall. The term "active" means that the devices that generate the radial forces use power for their operation. The availability of power downhole is limited by the necessity to communicate through a long logging cable. Since part of the power is used for actuating the grip, tractors employing active grips tend to have less power available for moving the tool string along the well. Thus, an active grip is likely to decrease the overall efficiency of the tractor tool. Another disadvantage of active grips is the relative complexity of such device and hence the risk of lower reliability.

In another downhole operations, tools are used to perform various mechanical services such as shifting sleeves, operating valves, as well as drilling, and cutting. In the tools, often one part of the tool performs a mechanical service during which it is necessary for the tool or another part of the tool to be anchored with respect to the wellbore. For example, in devices that are used to shift sleeves and operate valves, an anchoring device locks the tool with respect to the well wall while a linear actuator pushes or pulls the operated sleeve or valve element with respect to the anchor. In another example, in which the mechanical services tool is used to drill out a plug, one part of the tool is anchored, while a linear actuator such as hydraulic cylinder provides the weight on the drill bit. All known mechanical services tools use active grip devices to anchor the tool. It would be advantageous to perform mechanical services using passive grip devices. Furthermore, it would be desirable to perform mechanical services in soft formation with a reduced gripping force to avoid the possibility of damage to the casing or wellbore wall.

A more efficient and reliable gripping device can be constructed by using a passive grip that does not require power for the generation of high radial forces. In such a device, the gripping force is generated when an attempt is made to displace the grip relative to the well wall. An important feature of the passive or self-actuating grips is that their gripping force increases automatically in response to an increase in the force that is trying to displace the grip with respect to the well wall. In one such design, the gripping action is achieved through sets of arcuate-shaped cams. One passive grip mechanism based on arcuate-shaped cams that pivot on a common axis located at the center of the tool is disclosed in U.S. Pat. No. 6,179,055, incorporated herein by reference. The cams are mounted on a retraction device that slides on rails that are part of the tractor tool body. Another passive grip mechanism based on cams is disclosed in U.S. Pat. No. 6,629,568, incorporated herein by reference. In this grip, the cams are located at the apex of a centralizer linkage mechanism, which geometry can be selectively made flexible or rigid with hydraulic or electro-mechanical means.

One disadvantage of these passive grip mechanisms is that the cams exert very high contact stresses on the well walls. In open hole wellbores having relatively soft formations, such high contact stress passive grip mechanisms may be unsuitable as they may damage the formation.

SUMMARY OF THE INVENTION

Embodiments of the present invention relate to downhole tools having passive grips that selectively grip or release a wellbore or casing wall over a large contact area, the tools being suitable for use in conveying logging tools in a well or perform various mechanical services such as opening valves, shifting sleeves, drilling, cleaning, and other mechanical services in a wellbore. The invention is generally applicable in downhole tools that need to be anchored with respect to their surroundings in order to perform various measurements and particularly applicable for use in downhole tractors and mechanical services tools. Potential for grips to damage the formation is reduced by the large contact area of the present invention. Some embodiments of the present invention also prevent any relative motion between the tool and the well bore in both uphole and downhole directions by gripping in a bi-directional manner.

Embodiments of the present invention include a mechanism that grips using a force applied in one direction to generate a much larger force in another direction, the latter being used to anchor the device with respect to its surroundings or to create traction. More specifically, the embodiments of the present invention relates to downhole tools that are either used to convey other logging tools in a well (downhole tractors) or perform various mechanical services such as opening valves, shifting sleeves, drilling, cleaning, and other mechanical services (mechanical services tools). Such mechanical services tools often need to be anchored with respect to the well bore in order to perform their operation. Embodiments of the present invention are also applicable to downhole tools that need to be anchored with respect to their surroundings in order to perform various measurements.

DETAILED DESCRIPTION OF THE INVENTION

Figure 1:
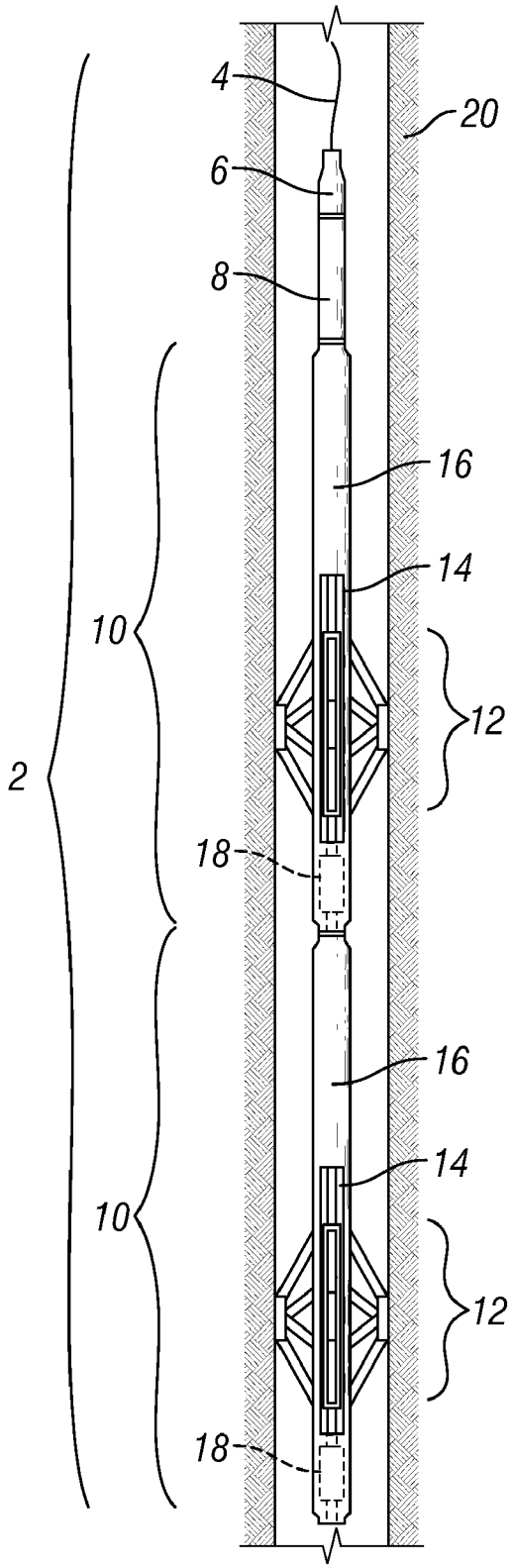
FIG. 1 is a side view of a grip assembly according to one embodiment of the present invention incorporated into a downhole tractor.

As shown in FIGS. 1-11, embodiments of the present invention are directed to a grip assembly that uses a force applied in one direction to generate a much larger force in another direction, the latter being used to anchor the grip assembly with respect to its surroundings or to create traction. In one embodiment a grip assembly 12 according to the present invention is incorporated into a downhole tractor assembly 2, such as that shown in FIG. 1. Note that in the accompanying figures, for vertically oriented figures the uphole direction is upwards and the downhole direction is downwards; and for horizontally oriented figures the uphole direction is to the left and the downhole direction is to the right. Also note that downhole tools, incorporating the present invention therein, as depicted and described herein may be used in vertical wells, horizontal wells and highly deviated wells.

Referring again to FIG. 1, the depicted tractor assembly 2 includes a logging cable 4, a cable head 6 that is connected to the logging cable 4, an electronics cartridge 8, and two identical tractor sondes 10. Each of the tractor sondes 10 is equipped with a grip assembly 12, which is reciprocated up and down in a window or slot 14 cut into the body 16 of each tractor sonde 10. Each grip assembly 12 is reciprocated by a drive mechanism 18 located inside the body 16 of each tractor sonde 10.

Each grip assembly 12 can selectively anchor itself with respect to a formation 20 in which a well 22 is drilled. For downhole tractoring, when the drive mechanism 18 attempts to move the grip assembly 12 in an uphole direction, the grip assembly 12 anchors itself against the well formation 20 in a manner that is discussed in detail below. With the grip assembly 12 anchored to the well formation 20, the attempt by the drive mechanism 18 to move the grip assembly 12 uphole, causes the remainder of the tractor system 2 to move in a downhole direction (thus, although the grip assembly 12 is stationary, it moves in the uphole direction with respect to its corresponding tractor sonde body 16 within the window 14.) This is referred to as the power stroke of the grip assembly 12.

However, when the drive mechanism 18 attempts to move the grip assembly 12 in the downhole direction, the grip assembly 12 does not become anchored to the well formation 20 and instead is allowed to slide freely with respect thereto, in a manner that is discussed in detail below. During this movement, the grip assembly 12 moves downwardly with respect to its corresponding tractor sonde body 16 within the window 14. This is referred to as the return stroke of the grip assembly 12. The return stroke resets the position of the grip assembly 12 with respect to the tractor sonde body 16 to allow another power stroke to be performed.

When more than one grip assembly 12 is used, as is shown in FIG. 1, each grip assembly 12 may be operated such that as one grip assembly 12 is in its power stroke, the other is in its return stroke and vice versa. Hence, the tractor assembly 2 moves in a continuous manner, driven by whichever grip assembly 12 is in its power stroke. For efficient tractor operation, it is preferable that the grip assemblies 12 automatically anchor against or release the formation 20 depending on the direction of its displacement. It is also preferable that the grip assemblies 12 are able to securely anchor themselves against the formation 20 and prevent any slippage with respect thereto when so anchored. These features of the grip assemblies 12 are described further below.

Figure 2:
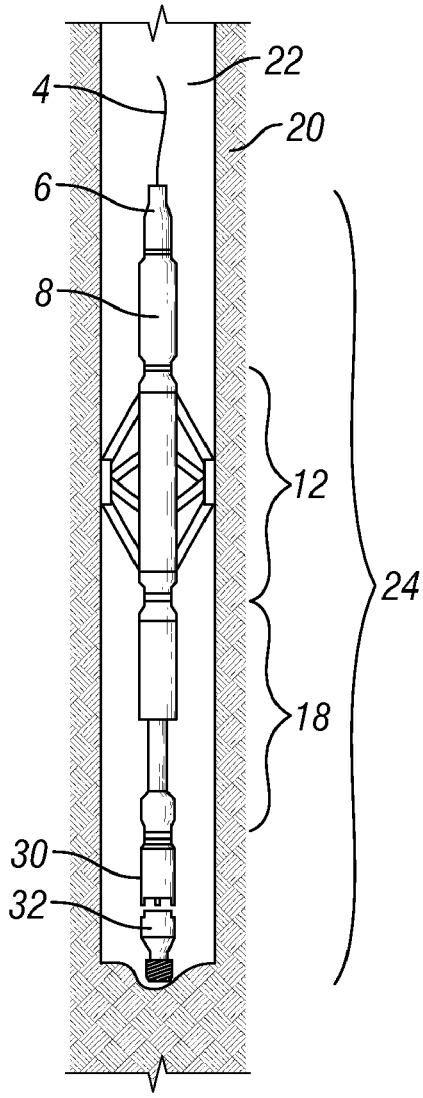
FIG. 2 is a side view of a grip assembly according to one embodiment of the present invention incorporated into a mechanical services tool.

FIG. 2 shows a possible location of the grip assembly 12 when used as an anchoring device in a mechanical services tool assembly 24. The mechanical services tool assembly 24 shown in this figure includes a cable 4, a cable head 6, an electronics cartridge 8, a grip assembly 12, a drive mechanism 18, a rotary module 30, and a drill bit 32. Note that addition modules may be attached to the assembly 24, for example at any location below the grip assembly 12. As such, the embodiment of the mechanical services tool assembly 24 shown in FIG. 2 is for illustrative purposes only.

Similar to the operation of the grip assembly 12 with respect to FIG. 1, in the mechanical services tool assembly 24 of FIG. 2, when the drive mechanism 18 attempts to move the grip assembly 12 in an upward or uphole direction, the grip assembly 12 anchors itself against the well formation 20 in a manner that is discussed in detail below. With the grip assembly 12 anchored to the well formation 20, an attempt by the drive mechanism 18 to move the grip assembly 12 in the uphole direction, causes the drill bit 32 to apply a downhole directed load. Note that although a drill bit 32 is shown, the drill bit 32 is merely representative of any appropriate mechanical services module for the performance of a mechanical services operation on a well.

Figure 3:
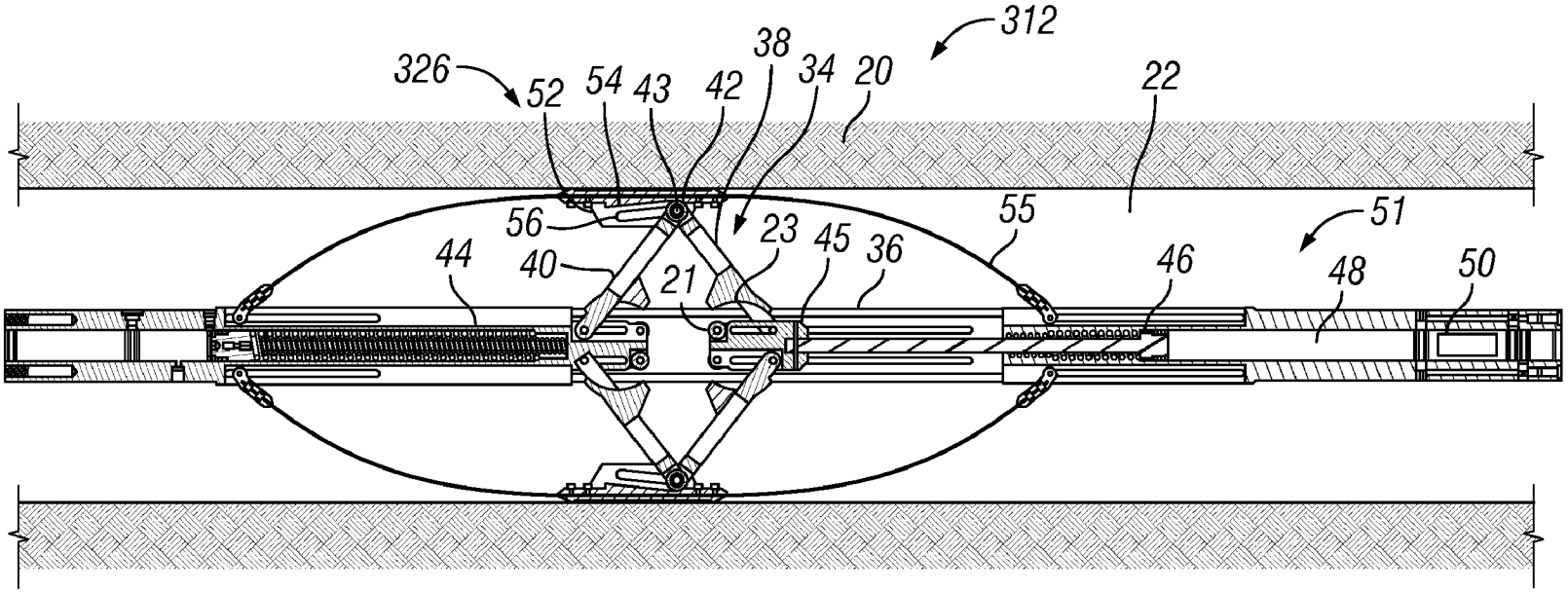
FIG. 3 is an enlarged side cross-sectional view of a grip assembly according to one embodiment of the present invention.

Mechanical and hydraulic embodiments of the grip assembly 12 are disclosed herein. A mechanical embodiment of a grip assembly 312 according to the present invention is shown in FIG. 3. The grip assembly 312 of FIG. 3 may be used in either of the embodiments of FIGS. 1 and 2. As shown, the grip assembly 312 includes a linkage 34 connected to an elongated gripper body 36. The gripper body 36, in turn, may be further connected to other elements to form the tractor assembly 2 of FIG. 1 or the mechanical services tool 24 of FIG. 2. In one embodiment, the linkage 34 includes a first arm 38 connected to the gripper body 36 by a movable hub 45, and a second arm 40 connected to the gripper body 36 by a stationary hub 44. Adjacent ends of the linkage arms 38,40 are pivotally connected to a each other by a wheel 42 having a wheel axle 43. With this configuration, a movement of the movable hub 45 away from the stationary hub 44 causes the arms 38,40 to move radially inwardly toward the gripper body 36 to radially contract the linkage 34 formed by the linkage arms 38,40; and a movement of the movable hub 45 toward the stationary hub 44 causes the linkage arms 38,40 to move radially outwardly from the gripper body 36 to radially expand the linkage 34 formed by the linkage arms 38,40. Note that each hub 45,44 includes a wheel 21 which rides along a inclined surface 23 of a wedge to facilitate the radial expansion or opening of the linkage 34 (see FIGS. 4A-4B for clarity.) Also note that the depicted wheel-on-wedge configuration of FIGS. 4A-4B may be replaced by a wedge-on-wedge configuration, as shown for example in the embodiment of FIGS. 6A-6B, or another similar force redirecting configuration. In addition, it can be seen from the embodiment of FIG. 3, that the movement of the linkage arms 38,40 in the opening direction causes a very large radial expansion of the linkage 34 away from the gripper body 36.

Attached to the linkage 34 is a force amplifier 326. The force amplifier 326 receives a force in a first direction and transfers it to a much larger force in another direction. In the embodiment of FIG. 3, the force amplifier 326 includes a saddle 52 having a ramp 54 in force transmitting relation to the linkage wheel 42. As discussed in detail below, when the linkage 34 is disposed in a radially expanded position, the linkage wheel 42 forces the saddle 52 into contact with the well formation 20. Attached to the saddle 52 is a bow spring 55, which has ends connected to the gripper body 36. The bow spring 55 guides the grip assembly 312 when passing through restrictions or obstructions in the well 22.

In one embodiment, the movable hub 45 is slibably movable substantially parallel to the gripper body 36 by a piston 46. One end of the piston 46 is slidable within a fluid chamber 48. Adjacent to the fluid chamber 48 is a hydraulic valve 50. When the hydraulic valve 50 is opened, a fluid is allowed to enter the fluid chamber 48 and apply an uphole directed force on the piston 46. The piston 46, in turn, applies an uphole directed force on the movable hub 45, causing the movable hub 45 to move toward the stationary hub 44 to move the linkage 34 into a radially expanded position. Once the linkage 34 has been expanded to a desirable radial distance, the hydraulic valve 50 may be closed.

In one embodiment, the linkage 34 is radially expanded until the saddle 52 attached thereto just touches the well formation 20 and begins to apply a small radially directed force thereagainst. When the desired radially expansion of the linkage 34 is achieved, the hydraulic valve 50 may be closed, thus trapping the fluid in the fluid chamber 48, and preventing a movement of the movable hub 45 in a direction away from the stationary hub 44 and hence locking the linkage 34 in a radially expanded position (i.e., in the locked position, the linkage 34, and hence the saddle 54, is prevented from moving radially inwardly.)

This assembly of the piston 46, the fluid chamber 48 and the hydraulic valve 50 may be referred to as an opening and locking device 51, since the assembly may function to both radially expand, or open the linkage 34, and to lock the linkage 34 in a desired expanded position. In the embodiment of FIG. 3, two linkages 34 are shown, with each linkage 34 being connected to the gripper body 36 and the opening and locking device 51 as described above. However, in other embodiments, the grip assembly 312 may include any appropriate number of linkages 34, preferable equally spaced about the circumference of the gripper body 36. Together, the combination of linkages 34 forms a centralizer. Alternative embodiments of opening and locking devices for a downhole centralizer are disclosed in U.S. Pat. No. 6,629,568, which is incorporated herein by reference.

As described above, the opening and locking device 51 can selectively translate and lock the position of the movable hub 45. When the movable hub 45 is locked with respect to the stationary hub 44, the geometry of the linkage 34 is also locked from moving radially inwardly (i.e., toward the gripper body 36). When the movable hub 45 is unlocked (i.e., when the hydraulic valve 50 is disposed in the opened position) the linkage 34 is movable and can be moved radially inwardly to accommodate changes in the borehole geometry. However, even in the unlocked position, a certain amount of fluid remains in the fluid chamber 48 adjacent to the piston 46 of the movable hub 45, such that in the unlocked position, the saddle 52 of each linkage 34, which forms the overall centralizer, remains in contact with the well formation 20 and exerts a small radial force thereon of a magnitude sufficient to allow the grip assemblies 312 to centralize the gripper body 36 with respect to the well 22.

As such, in one embodiment, the saddle 52 of each linkage 34 remains in contact with the well formation 20 when the linkage 34 is in both the locked and unlocked positions. Thus, in an embodiment where two grip assembly 312 are used for tractoring, each grip assembly 312 remains in a radially expanded position and in contact with the well formation 20 during both the power stroke and the return stroke. This is in contrast to typical grip assemblies, which when used for tractoring are reciprocated between retracted positions (close to the tool body and out of contact with the well formation) and expanded positions (anchored to the well formation.) However, this prior art movement of the grip assembly between the expanded and retracted positions requires a lot of energy and power consumption. By eliminating, or at a minimum, reducing this radial movement of the grip assembly 312, as it is reciprocated between the power stroke and the return stroke, a great deal of power consumption is saved.

Figure 4A:
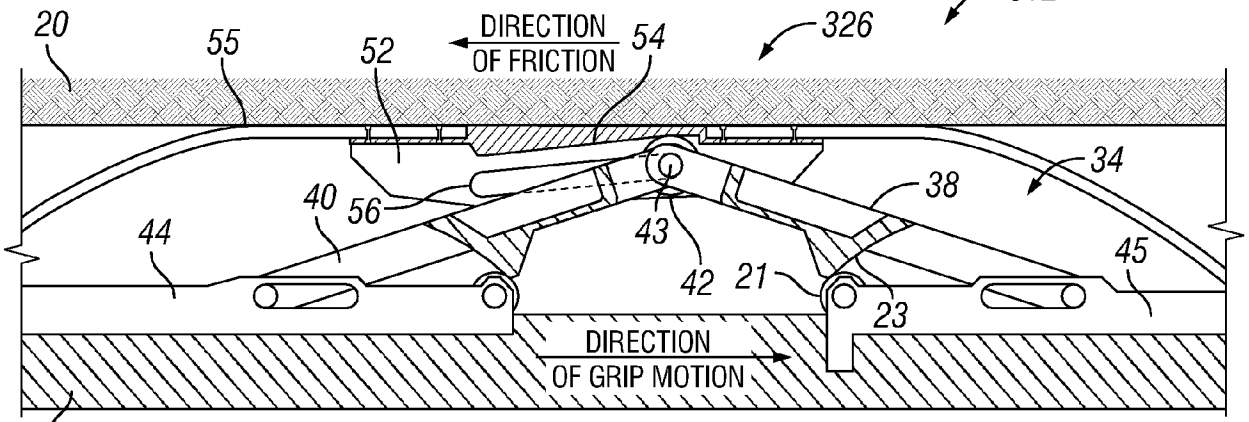
FIGS. 4A-4B are enlarged side partial cross-sectional views of the grip assembly of FIG. 3 according to one embodiment of the present invention.
Figure 4B:
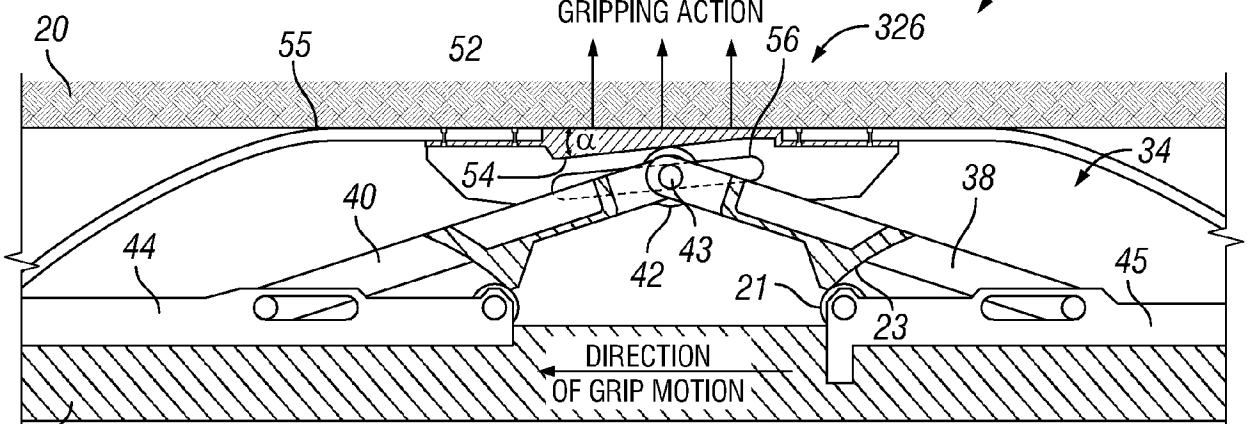

FIGS. 4A and 4B show an enlarged view of the grip assembly 312 of FIG. 3. As discussed above, the operation of the tractor 2 of FIG. 1 involves continuous reciprocation of a grip assembly 12. The grip assembly 312 of FIGS. 4A and 4B is useful for such a purpose. In operation, when the grip assembly 312 is reciprocated downhole by the drive mechanism 18 (such as that shown in FIG. 1), the opening and locking device 51 unlocks the movable hub 45 and the linkage 34 becomes movable in the radially inward direction. However, as discussed above, even in the unlocked position, the linkage 34 continues to exert a small radially outwardly directed force on the saddle 52, such that the saddle 52 remains in contact with the well formation 20 for the purpose of centralizing the tool. As the linkage 34 begins to move in the downhole direction with respect to the well formation 20 (as shown in FIG. 4A), a friction force is generated at the sliding interface between the saddle 52 and the well formation 20. This friction force is relatively small as it is generated by the small radial force applied from the saddle 52 to the well formation 20. This friction force is small in magnitude and therefore not able to prevent the sliding movement of the grip assembly 312 with respect to the well formation 20. However, even though it is small in magnitude, this friction force is sufficient to move the linkage wheel axle 43 to the downhole end of a saddle slot 56, within which it rides. As shown in FIGS. 4A-4B, the linkage wheel axle 43 is disposed in this saddle slot 56. This slot 56 limits the length of travel of the linkage wheel axle 43. With the linkage wheel axle 43 disposed in the downhole end of a saddle slot 56, the grip assembly 312 is reset and ready to begin a power stroke.

At the end of the above described downhole movement of the grip assembly 312 (the return stroke), the opening and locking device 51 is locked (such as by closing the hydraulic valve 50) to lock the movable hub 45, and consequently lock the geometry of the linkage 34 to prevent it from moving radially inwardly. With the linkage 34 locked, the drive mechanism 18 (such as that shown in FIG. 1) exerts an uphole force on the grip assembly 312 (a power stroke.) However, when an attempt is made to force the grip assembly 312 in the uphole direction as shown in FIG. 4B, the linkage wheel 42 attempts to ride along the on the saddle ramp 54 (as shown in FIG. 4B,) which is angled downwardly or declined in the uphole direction. Since the saddle 52 is already in contact with the well formation 20, the linkage wheel 42 can only ride along the saddle ramp 54 if the saddle 52 is allowed to move radially outwardly and dig into the formation. If the well formation 20 is soft enough, this is possible. However, as discussed below, the geometry of the saddle 52 may be chosen to have a large area of contact with the well formation 20 in order to minimize the possibility of the saddle 52 digging into the well formation 20, even in soft formations. When the compressive stress in the well formation 20 is strong enough to prevent the saddle 52 from digging therein, the saddle 52 is prevented from moving radially outwardly, and the linkage wheel 42 is prevented from movement along the saddle ramp 54. As such, a large moment is created which amplifies the force applied by the drive mechanism 18 to the linkage 34 to a much larger radial force from the saddle 52 to the well formation 20, causing the saddle 52 to anchor therein.

Note that although it appears from viewing FIGS. 4A and 4B together that the linkage wheel 42 has moved along the saddle ramp 54 during the power stroke, this movement is exaggerated for illustrative purposes. In actuality, the linkage wheel 42 is unlikely to move during the power stroke, as such movement would result in the saddle 52 digging into the well formation 20, which the saddle 52 is specifically designed not to do.

The degree of the amplification of the force from the drive mechanism 18 to the saddle 52 is determined by the taper angle $\alpha$ (see FIG. 4B) of the saddle ramp 54. In the depicted embodiment, the force amplification is equal to 1 divided by the tangent of the taper angle $\alpha$ (see FIG. 4C and the accompanying paragraph below for clarity.) In one embodiment, the taper angle $\alpha$ is chosen such that the force amplification is 10. In such an embodiment, a force of 1000 pounds applied from the drive mechanism 18 to the linkage 34 in the uphole direction results in a 10,000 pound radial force applied from the saddle 52 to the well formation 20. This radial force gives rise to a very high friction force between the saddle 52 and the well formation 20, which prevents any relative motion between the saddle 52 and the well formation 20, and hence prevents any relative motion between the grip assembly 312 and the well formation 20. With the grip assembly 312 anchored to the well formation 20, the attempt by the drive mechanism 18 to move the grip assembly 312 uphole causes the remainder of the tractor system 2 to move downhole.

Figure 4C:
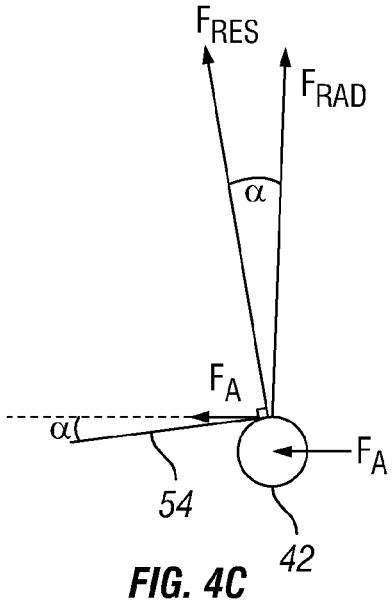
FIG. 4C is a force diagram illustrating a force amplification of the grip assembly of FIG. 3.

FIG. 4C shows a force diagram illustrating this force amplification. As shown, an axial Force, $F_A$, applied to the linkage wheel 42 results in a resultant force, $F_{RES}$, on the saddle 52 in a direction perpendicular to the point of contact between the saddle ramp 54 and the linkage wheel 42. Broken down into its axial and radial components, this resultant force, $F_{RES}$, has an axial component equal to the axial Force, $F_A$, applied to the linkage wheel 42, and a much larger radial component, $F_{FAD}$, applied to the saddle 54. As can be seen by this force diagram, for any given axial Force, $F_A$, the smaller the angle $\alpha$, the larger the radial component, $F_{RAD}$, of the resultant force $F_{RES}$ on the saddle 52. As a result, as mentioned above, the degree of the amplification of the force from the drive mechanism 18 to the saddle 52 is determined by the taper angle $\alpha$ of the saddle ramp 54.

Note that the force with which the saddle 52 is driven into the well formation 20 is proportional to the force that tries to displace the grip assembly 312 uphole. The harder the drive mechanism 18 tries to displace the grip assembly 312, the harder the saddle 52 anchors into the well formation 20. Also note that the contact area over which the interaction between the grip assembly 312 and the well formation 20 occurs is the entire top surface 60 of the saddle 52 (as shown in an exemplary embodiment of the saddle 52 in FIGS. 5A-5C.) This depicted configuration of the saddle 52 allows for an area of contact with the well formation 20. This area contact decreases the contact stress on the well formation 20 and minimizes the possibility of any sinking, digging, plowing or other formation damage that the saddle 52 might cause during anchoring. By contrast, substituting the depicted area contact saddle 52 with a cylindrical cam or a toothed cam results in a line of contact and a point of contact, respectively, with the well formation 20, both of which are likely to cause formation damage in soft formations during anchoring.

Figure 5B:
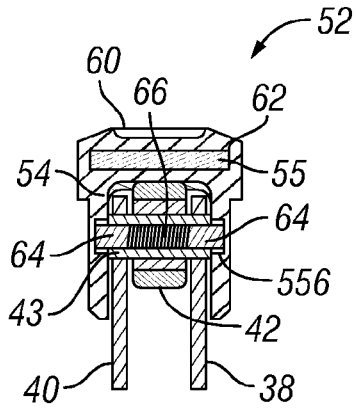
FIGS. 5B and 5C are enlarged views of a saddle of the grip assembly of FIG. 3.
Figure 5C:
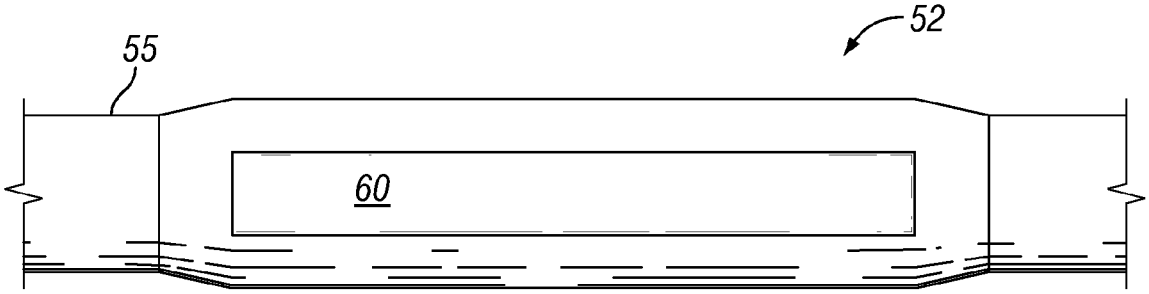
Figure 5A:
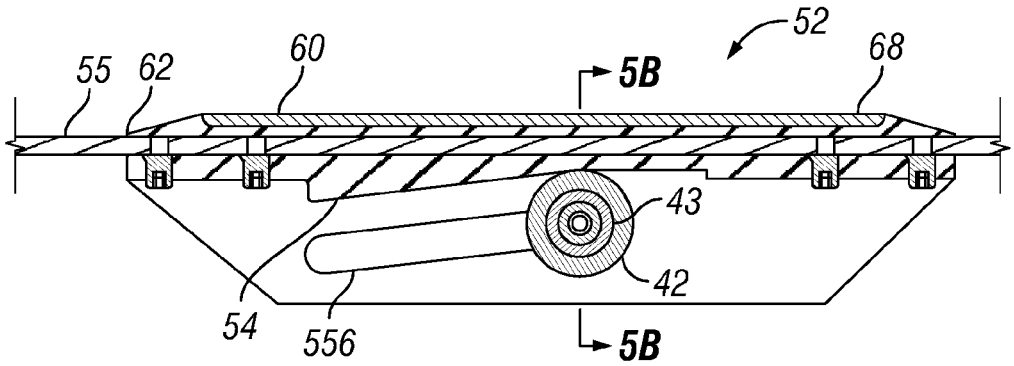
FIG. 5A is a partial side cross-sectional view of a saddle of the grip assembly of FIG. 3.

Also, in the embodiment of FIGS. 5A-5C, the saddle 52 includes an channel 62 through which the bow spring 55 extends. In one embodiment the bow spring 55 is composed of a metal material, such as titanium. The bow spring 55 adds rigidity and torsional resistance to the saddle 52. As is also shown, the saddle slot 56, discussed above, may extend through the opposing side arms of the saddle 52. However, in the embodiment shown in FIG. 5B, the saddle slot 556 is formed as a recess into the saddle side arms. As shown, each recess 556 receives one of a pair of pins 64 extending from the wheel axle 43. Each pin 64 is biased toward its corresponding recess 556 by a biasing member 66, such as a compression spring. Upon the application of an undesirably high torque on the saddle 52, the pins 64 break or otherwise become disengaged from the saddle 52. Although this is undesirable, its repair is relative easy and inexpensive in comparison to other embodiments where the axle is more rigidly or fixedly attached to the saddle. In such a configuration, an undesirably high torque on the saddle 52, may cause a breakage of each of the saddle 52, the wheel 42, the wheel axle 43, and the linkage arms 38,40.

In one embodiment, as shown in FIGS. 5A-5C, a trench 68 (see FIG. 5A) is formed in the top surface of the saddle 52. After its formation, the trench 68 is then filled with a material that is harder than the remaining portions of the saddle 52. For example, in one embodiment the channel 68 is filled with a laser deposited tungsten carbide material and the remainder of the saddle 52 is composed of a stainless steel material.

Figure 6A:
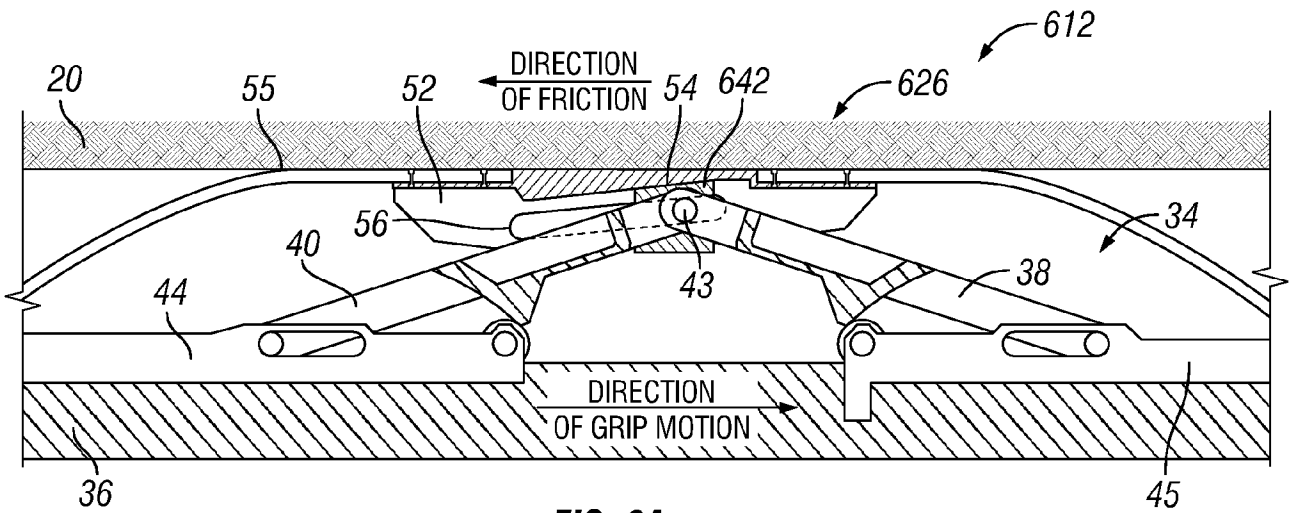
FIGS. 6A-6B are side partial cross-sectional views of a grip assembly according to another embodiment of the present invention.
Figure 6B:
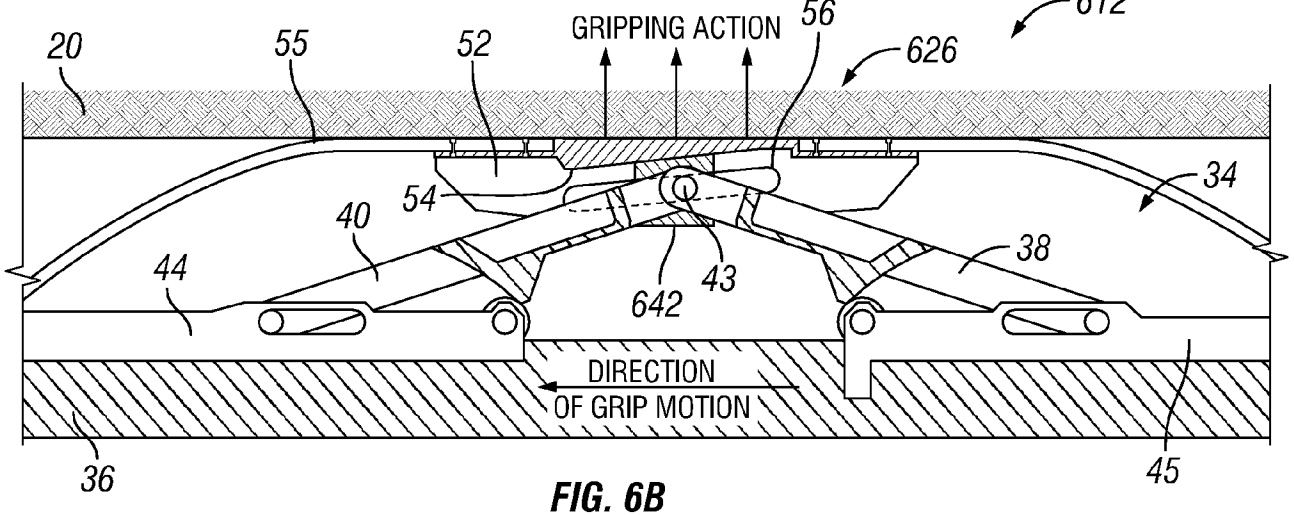

Another embodiment of a grip assembly 612 according to the present invention is shown in FIGS. 6A-6B. In this embodiment, the grip assembly 612 includes a force amplifier 626 having a wedge 642 in force transmitting relation with the saddle ramp 54. As such, the wedge 642 in the embodiment of FIGS. 6A-6B replaces the wheel 42 from the embodiment of FIGS. 4A-4B. In all other respects, the embodiment of FIGS. 6A-6B operates in the same manner as the embodiment of FIGS. 4A-4B.

Figure 7A:
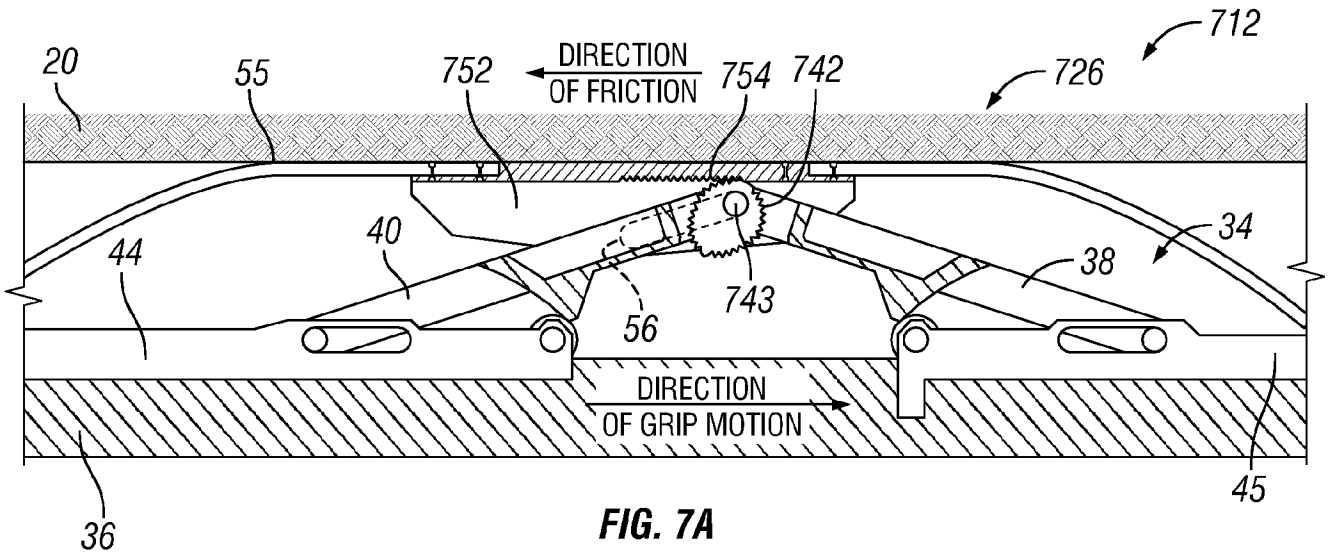
FIGS. 7A-7B are side partial cross-sectional views of a grip assembly according to another embodiment of the present invention that utilizes a toothed cam and a gear rack as a mechanical force amplifier.
Figure 7B:
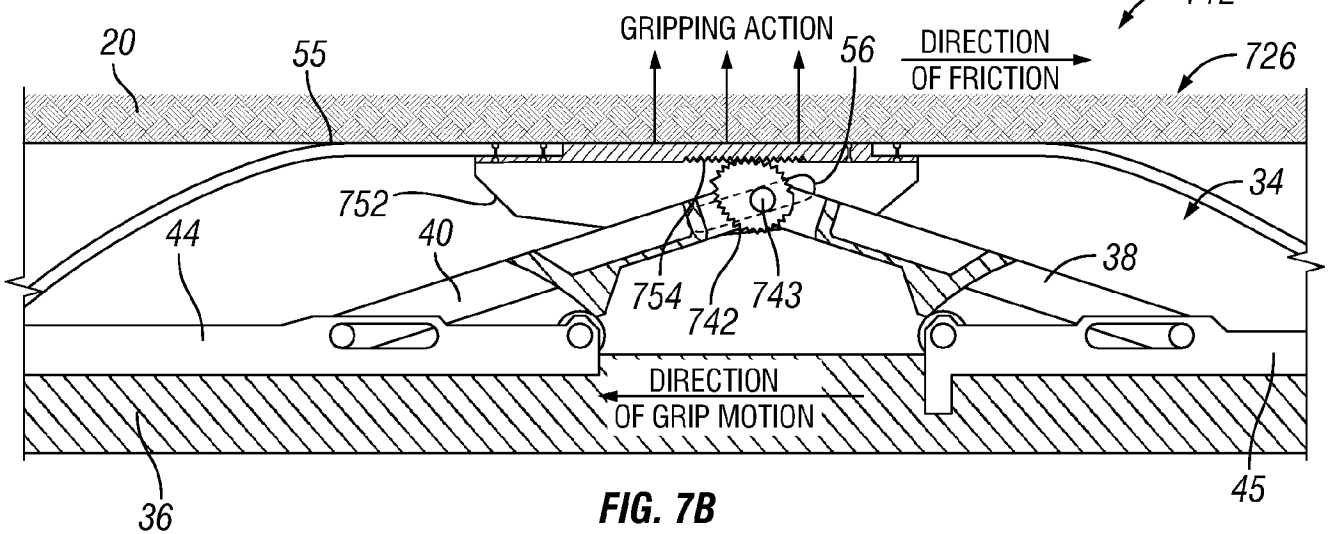

Another embodiment of a grip assembly 712 according to the present invention is shown in FIGS. 7A-7B. In this embodiment, the grip assembly 712 includes a force amplifier 726 having a toothed cam 742 in force transmitting relation with a meshing gear rack 754 on the bottom surface of the saddle 752. In a similar manner to that described above with respect to FIGS. 4A-4B, when the linkage 34 is locked and an uphole force is applied thereto, an amplified force is applied to the saddle 752 in the radial direction due to the interaction of the cam axle 743 with the saddle slot 56, and the toothed cam 742 with the gear rack 754 on the saddle 752. As such, the force amplifier 726 in the embodiment of FIGS. 7A-7B replaces the force amplifier 326 from the embodiment of FIGS. 4A-4B. In all other respects, the embodiment of FIGS. 7A-7B operates in the same manner as the embodiment of FIGS. 4A-4B.

Note that for each of the embodiments shown in FIGS. 4A-7B, two conditions facilitate a movement of the grip assembly 312,612,712 with respect to the well formation 20, i.e., a downhole force is applied to the grip assembly 312,612, 712 and the linkage 34 is unlocked. Similarly, two conditions facilitate the anchoring of the grip assembly 312,612,712 with the well formation 20, i.e., an uphole force is applied to the grip assembly 312,612,712 and the linkage 34 is locked from moving radially inwardly. Thus, each of these embodiments is unidirectional by construction as it is designed to tractor or anchor in one specific direction.

Figure 8A:
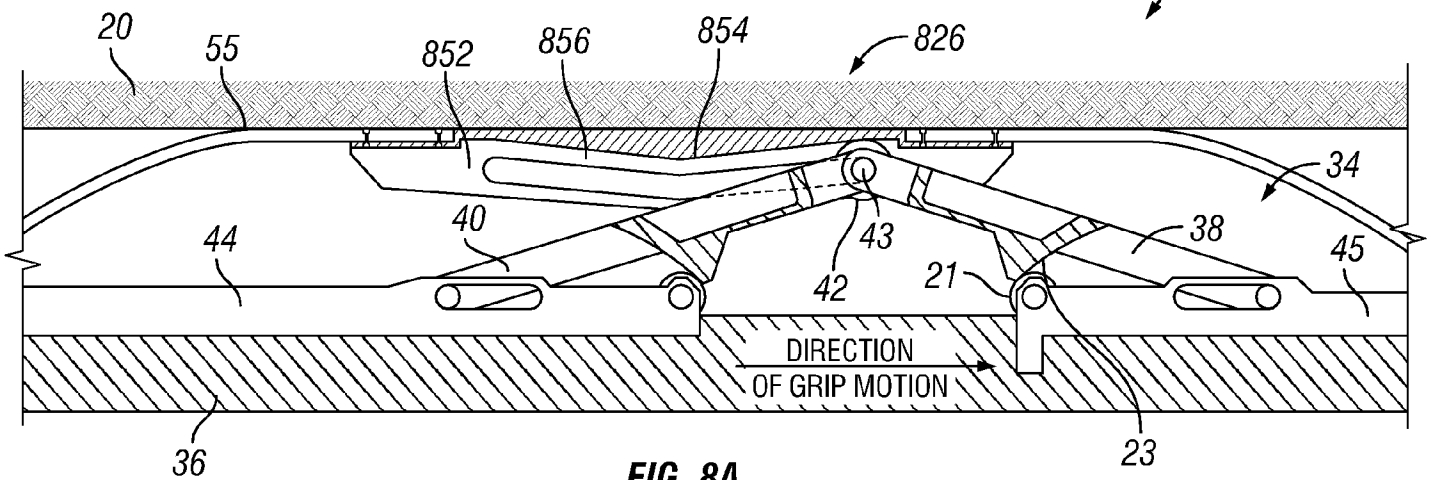
FIGS. 8A-8B are side partial cross-sectional views of a grip assembly according to another embodiment of the present invention that is bi-directionally operable.
Figure 8B:
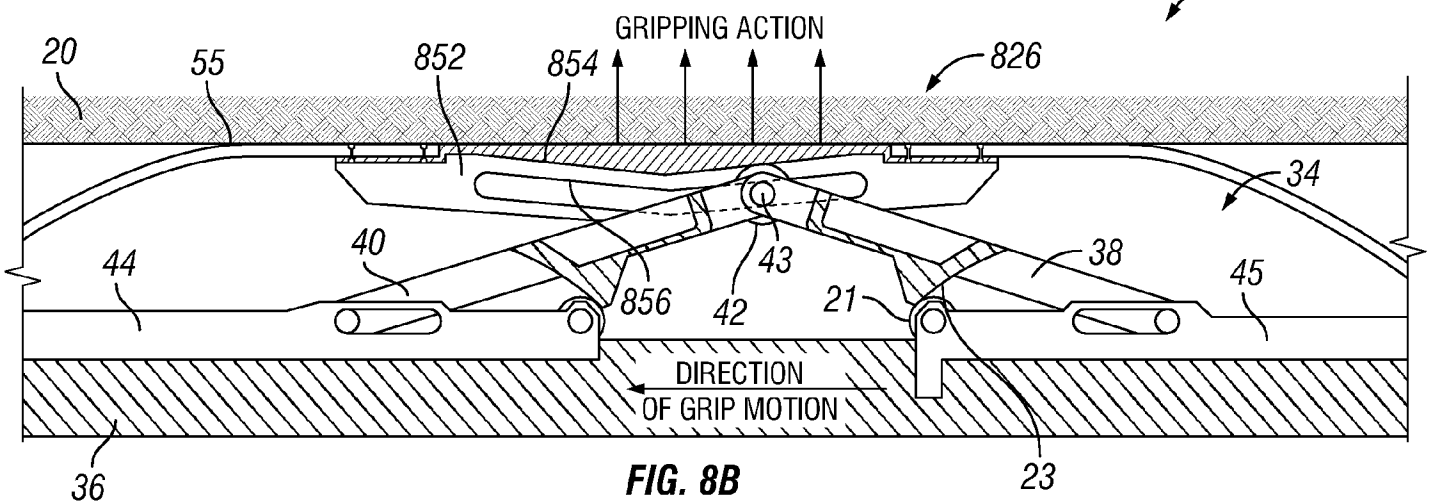

By contrast, FIGS. 8A-8B show a gripping device 812 which is bi-directional, allowing for both uphole and downhole anchoring or tractoring. In all other respects, the embodiment of FIGS. 8A-8B operates in the same manner as described above for the embodiment of FIGS. 4A-4B. The bi-directional anchoring or tractoring of the embodiment of FIGS. 8A-8B is made possible by incorporating a saddle slot 856 which is "V" shaped, and incorporating a saddle ramp 754 which is correspondingly "V" shaped.

In the position shown in FIG. 8A, the linkage wheel 42 is in the downhole most portion of the saddle slot 856. In this position, locking the linkage 34 and applying an uphole force on the grip assembly 812 allows for tractoring in the downhole direction as described above. When it is desired to tractor in the uphole direction, the linkage wheel 42 may be positioned in the uphole most portion of the saddle slot 856. In order to move the linkage wheel 42 from the downhole most portion to the uphole most portion of the saddle slot 856, the linkage 34 is unlocked and an uphole force is applied to the grip assembly 812, this allows the linkage wheel 42 to move freely within the slot 856.

When the linkage wheel 42 is in the uphole most portion of the saddle slot 856, the linkage 34 may be locked, and a downhole force may be applied to the grip assembly 812. Since, from this position, the saddle ramp 854 is angled downwardly or declined in the downhole direction, a force applied on the linkage wheel 42 in the downhole direction causes an amplified force to be applied to the well formation 20 by the saddle 852 (as described above with respect to FIGS. 4A-4B), thus the grip assembly 812 becomes anchored to the well formation 20 and the downhole force applied to the grip assembly 812 allows the remainder of the tractor 2, or other assembly to which the grip assembly 812 is attached, to move in the uphole direction. Each of the embodiments of FIGS. 6A-6B and 7A-7B may similarly be made bi-directional by incorporation of a V-shaped slot similar to that shown in FIGS. 8A-8B.

Each of the embodiments discussed above may include a saddle, such as the saddle 52 of FIGS. 5A-5C, that is in contact with the well formation at all times. When the grip assembly moves with respect to the formation (the return stroke), the saddle is pressed against the formation with a small force, while during anchoring (the power stroke), the saddle is pressed against the formation with a very large force. The fact that the same saddle surface is in contact with the formation both during movement and anchoring presents some difficulties as there are conflicting requirements for the properties of that surface. When the grip device is displaced along the wellbore as required by a tractoring operation during a return stroke, it would be beneficial to have a very low friction coefficient between the saddle and the formation in order to reduce frictional power loss. On the other hand, during the anchoring process of the power stroke a very high friction coefficient is desirable as this minimizes the contact force required for anchoring, which, in turn, decreases the stress on all mechanical components of the tool.

Figure 9A:
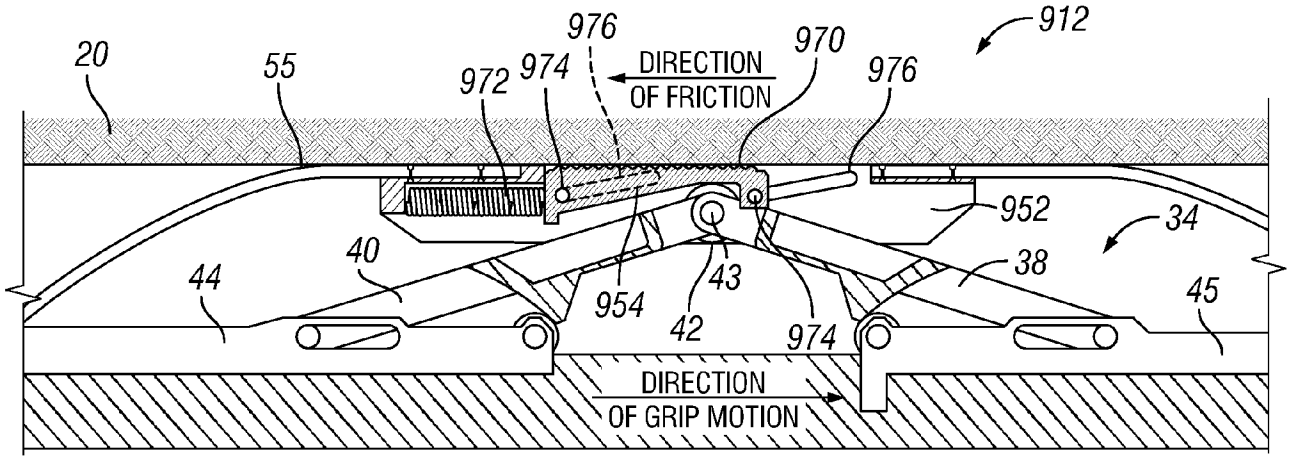
FIGS. 9A-9B are side partial cross-sectional views of a grip assembly according to another embodiment of the present invention that have a saddle with a variable coefficient of friction.
Figure 9B:
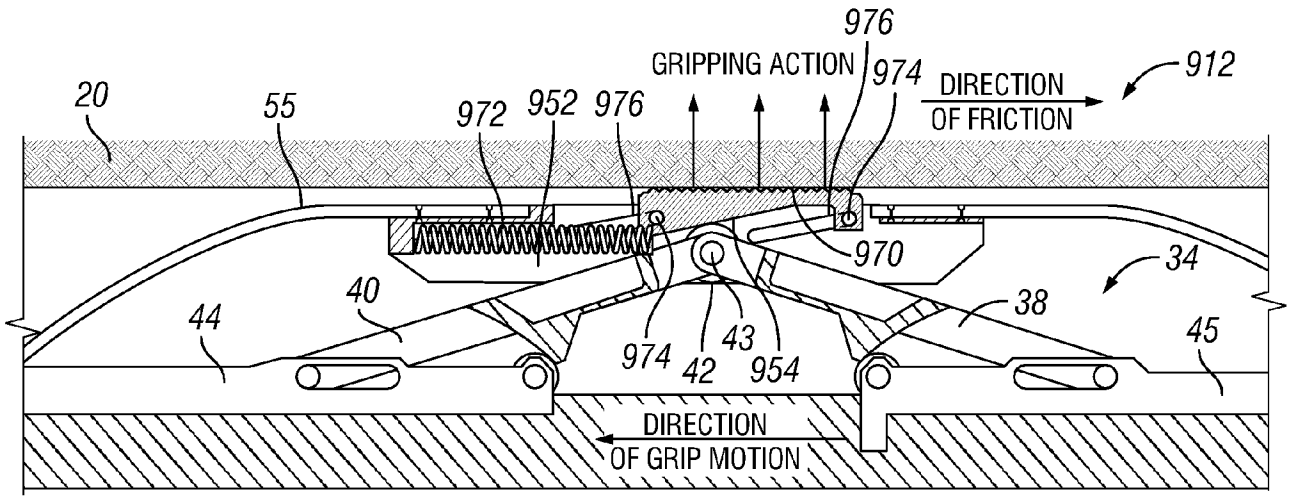

This difficulty is addressed by the embodiment shown in FIGS. 9A-9B. This is done by separating the contact surface that is used for anchoring from the contact surface that is in contact with the formation during movement with respect thereto. In its principle of operation, the embodiment of FIGS. 9A-9B is similar to the embodiment of FIGS. 4A-4B. However, it has two additional components, a gripping pad 970 and a biasing member, such as a spring 972, which biases the 970 pad in the downhole direction. The gripping pad 970 is attached to the saddle 952 by two pins 974, which slide in slots 976 cut in side walls of the saddle 952. With this embodiment, the top surface of the gripping pad 970, which comes in contact with the well formation 20 during the anchoring process as described in detail below, can be made more aggressive than the top surface of the saddle 952 which is in contact with the well formation 20 during a return stroke. Note that the top surface of the saddle 952 in the embodiment of FIGS. 9A-9B may be the same as that shown and described with respect to the top surface 60 of the saddle 52 of FIG. 5C. Another difference with the embodiment of FIGS. 4A-4B and the embodiment of FIGS. 9A-9B is that the saddle slot 56 of FIGS. 4A-4B is replaced by a hole in a side wall of the saddle 952. In the embodiment of FIGS. 9A-9B, the wheel axle 43 is fixed to the saddle 952 through this saddle side wall hole to fix the position of the wheel 42 with respect to the saddle 952.

In FIG. 9A a return stroke is shown where a downhole force is applied to the grip assembly 912, and the opening and locking device 51 (not shown, but as described with respect to FIG. 3) is unlocked, allowing the linkage 34 to move radially inwardly. As the grip assembly 912 begins to slide with respect to the well formation 20, a friction force arises at the interface between the gripping pad 970 and the well formation 20. This uphole directed friction force drives the pad 970 toward the uphole-most portion of the saddle slots 976 and in the process compresses the relatively weak spring 972. As the pad 970 slides in the uphole direction with respect to the saddle 952, the pad 970 moves radially away from the well formation 20 because of the inclination of the slots 976. By the time the pad 970 reaches the uphole-most portion of the slots 966, the top surface 60 of the saddle 952 is in full contact with the well formation 20. In such a position, the saddle 952 carries the centralizing force applied by the linkage opening and locking device 51.

Although, the pad 970 does remain in contact with the well formation 20 during the entire return stroke, the force that pushes it against the well formation 20 is the spring 62. This spring force is much lower than the force that is applied by the opening and locking device 51 to the saddle 952. The reason for this force disparity is that the force applied by the opening and locking device 51 is designed to keep the tool centralized in the well bore, while the force of the spring 962 is designed merely to keep the gripping pad 60 in continuous contact with the well formation 20. Thus, the major frictional interaction between the well formation 20 and the grip assembly 912 during a return stroke occurs at the top surface 60 of the saddle 952, which can be designed to have a minimal coefficient of friction, and thus enable the grip assembly 912 to slide relative to the well formation 20 during the return stroke.

The anchoring process of this embodiment is shown in FIG. 9B. To anchor this grip assembly 912, the linkage 34 is locked by locking the opening and locking device 51, and an uphole directed force may then be applied to the grip assembly 912 by a drive mechanism (such as the drive mechanism 18 of FIG. 1.) The friction force at the gripping pad 970 is now in the downhole direction. This frictional force keeps the pad 970 in contact with the well formation 20, while the saddle 952 and the rest of the grip assembly 912 begin to move in the uphole direction. This motion causes an interaction between the pad pins 974 and the ramp slots 976 which moves the saddle 952 out of contact with the well formation 20. At the same time, as the grip assembly 912 moves in the uphole direction, the linkage wheel 42 attempts to ride along an inclined surface or ramp 954 in the pad 970. However, since the pad 970 is already in contact with the well formation 20 attempts by the linkage wheel 42 to ride along the pad ramp 954 merely drive the pad 970 more forcefully into the well formation 20. In this manner the interaction of the pad ramp 954 with the linkage wheel 42 acts to amplify a force in one direction to a much larger force in another direction as described above with respect to the force amplifier 326 of FIG. 3.

As the pad 970 is driven towards the well formation 20, the top surface 60 of the saddle 952 looses its contact with the well formation 20 and the frictional interaction between the grip assembly 312 and the well formation 20 occurs only over the top surface of the pad 970, which is designed to have a relatively high coefficient of friction. The high coefficient of friction between the pad 970 and the well formation 20 enables anchoring of the grip assembly 912 with a much lower overall force applied to the grip assembly 912 by the drive mechanism 18. As shown, in one embodiment the top surface 60 of the saddle 952 is substantially smooth, with the top surface of the pad 970 is rough, or even toothed. Thus, the coefficient of friction on the top surface of the pad 970 is much greater than the coefficient of friction on the top surface 60 of the saddle 952.

The embodiment shown in FIGS. 9A and 9B is unidirectional and uses the same force amplification principles as described with respect to FIGS. 4A and 4B. Similar to the later, it is possible to construct a bi-directional device that operates on the same principle as the device shown in FIGS. 8A-8B. It is also possible to use a cam and a gear rack in place of the wheel and saddle and to combine them with the gripping pad and the spring in order to produce another embodiment that has separation of contact surfaces during sliding and anchoring. Other combinations of pads, springs, and mechanical amplification elements are also possible to produce a great variety of mechanical self-locking devices. All these devices, however, are characterized by a large area of contact between the grip assembly and the well formation and by the presence of a mechanical amplifier.

Figure 10:
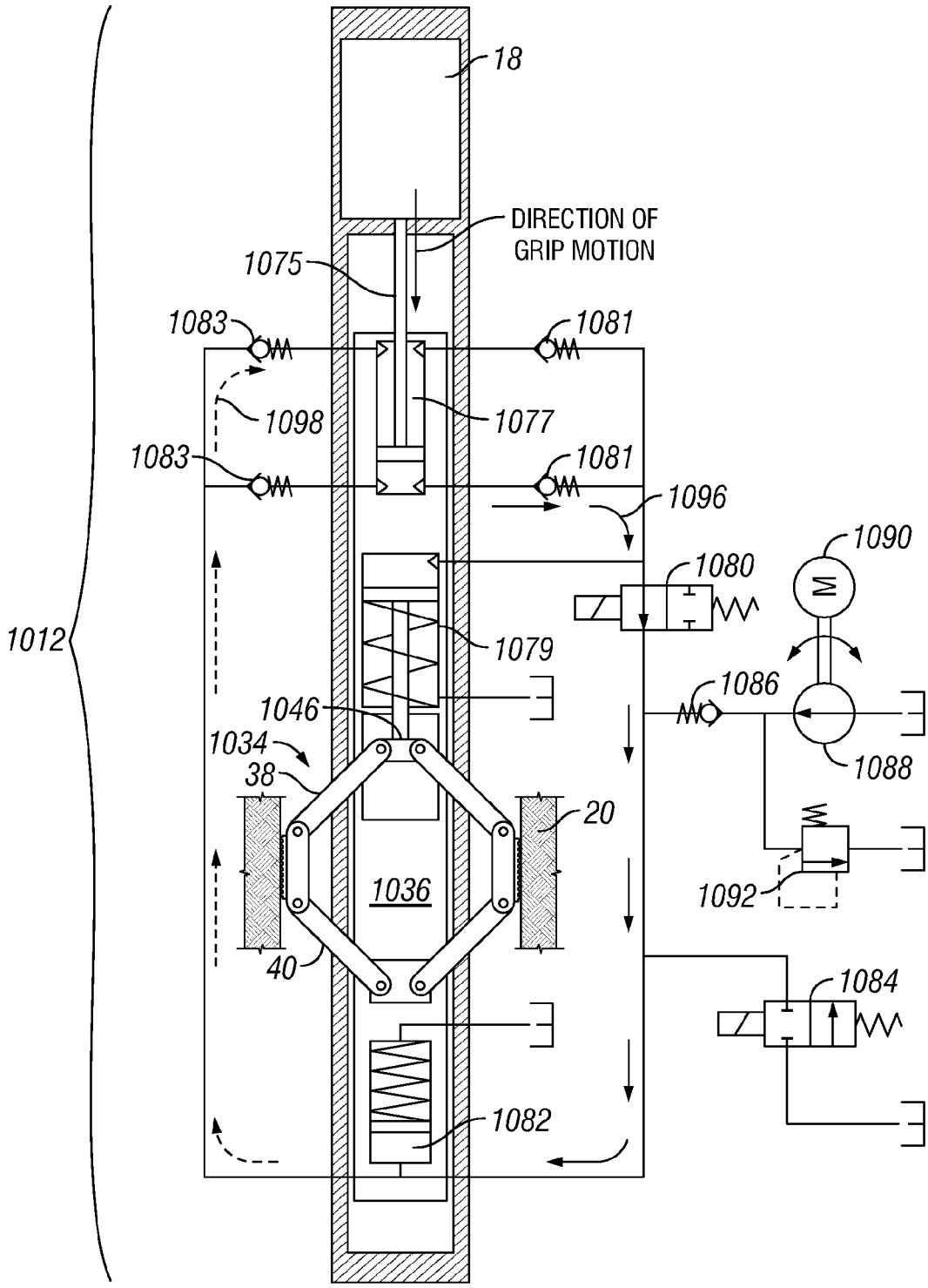
FIGS. 10 and 11 are side cross-sectional views of a grip assembly according to another embodiment of the present invention that utilizes a hydraulic force amplifier.
Figure 11:
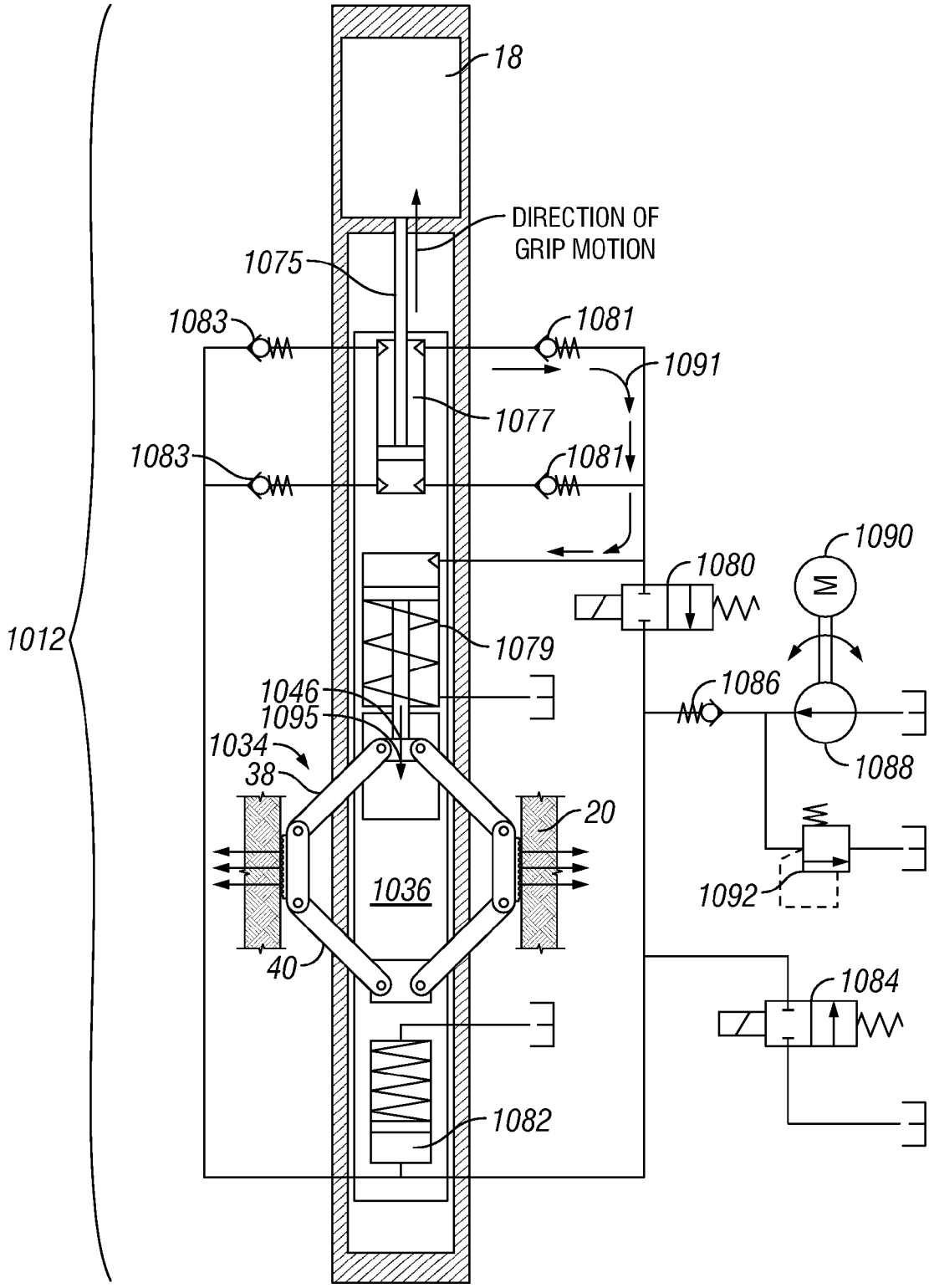

The above embodiments show various grip assemblies with mechanically based force amplifiers. However, similar amplification results may be achieved by use of hydraulic amplifiers, such as that shown in FIGS. 10 and 11. A hydraulic diagram representing a hydraulic embodiment of a grip assembly 1012 according to one embodiment of the invention is shown in FIGS. 10 and 11. In this embodiment, the hydraulic force amplifier includes first and second hydraulic cylinders 1077 and 1079. Associated with the hydraulic cylinders 1077,1079 are check valves 1081 and 1083, a solenoid valve 1080, and a hydraulic accumulator 1082. Other elements of the hydraulic grip assembly 1012 include a solenoid valve 1084, a check valve 1086, a hydraulic pump 1088 driven by a motor 1090, and a pressure relief valve 1092. The presence or absence of each individual element listed in this paragraph does not change the principle of operation of the grip assembly 1012, but they make it easier to integrate into a specific tool system such as the downhole tractor tool 2 of FIG. 1 or the mechanical services tool 24 of FIG. 2.

As shown, the hydraulic cylinders 1077,1079 function to amplify a force from a drive mechanism 18. As explained below, the hydraulic cylinders 1077,1079 function in the manner described above with respect to the mechanical amplifiers. In one embodiment, the hydraulic cylinder grip assembly 1012 includes a linkage 1034 having a first arm 38 movably connected to a piston 1046 of the second hydraulic cylinder 1079, and a second arm 40 pivotally attached to the gripper body 1036. Note that in this embodiment the opening and locking device 51 is not needed. In addition, a saddle 1052 for engagement with the well formation 20 is disposed between the linkage arms 38, 40. The saddle 1052 may be substantially similar to the saddle 52 of FIG. 3, but pivotally attached to linkage arms 38,40 rather than attached by a arrangement such as the wheel and ramp arrangement of FIG. 3.

In the embodiment shown in FIGS. 10 and 11, the pump 1088 is turned on only initially to open up the linkages and pump-up the accumulator 1082, after which it is switched off. The solenoid valve 1084, on the other hand, is energized all the time during normal operation. When turned off it dumps all fluid from the accumulator 1082 back to the oil reservoir. This provides a fail-safe operation of the tool, which closes during a loss of power or a power down situation. Note that all of the hydraulic elements shown in FIGS. 10 and 11 are in reality located inside the grip assembly 1012, but for clarity are shown external to the grip assembly 1012.

In FIG. 10, the drive mechanism 18 exerts a force on the grip assembly 1012 in the downhole direction, which represents a return stroke of the grip assembly 1012. The downhole force from the drive mechanism 18 drives a piston 1075 of the first hydraulic cylinder 1077 in the downhole direction. Fluid is displaced from a downhole side of the first hydraulic cylinder piston 1075, through one of the check valves 1081, and into the accumulator 1082 as indicated by solid arrows 1096. At the same time, fluid flows from the accumulator 1082 to the uphole side of the first hydraulic cylinder piston 1075 through check valve 1083 as indicated by dashed arrows 1098. Eventually the first hydraulic cylinder piston 1075 reaches the end of its stroke, after which the drive mechanism 18 exerts a downhole force directly onto the gripper body 1036, which moves downhole in response thereto.

During the return stroke, the grip assembly 1012 must slide freely with respect to the well formation 20. Note that during the return stroke, locking solenoid valve 1080 is not energized and there is a free flow of fluid between the second hydraulic cylinder 1079 and the accumulator 1082. This allows for a flow of fluid from the first hydraulic cylinder 1077 to the accumulator 1082. In addition, if the grip assembly 1012 during its motion encounters a reduction in well bore size, the linkage 1034 will have to move inwards, driving the piston 1046 of the second hydraulic cylinder 1079 in the downhole direction, this causes the second hydraulic cylinder piston 1046 to displace oil through the solenoid valve 1080, into the accumulator 1082, thus moving the accumulator piston and compressing the accumulator spring. If the grip assembly 1012 encounters an enlargement in well bore size, oil will flow in the opposite direction, from the accumulator 1082, and to the second hydraulic cylinder 1079 to fill up the volume voided when the piston 1046 of the second hydraulic cylinder 1079 in the uphole direction. Thus, the second hydraulic cylinder 1074 and the accumulator 1082 keep the tool centralized, and provide the flexibility needed to accommodate changes in well bore size.

Note that the linkage saddle 1052 remains in contact with the well formation 20 at all times. The contact force between the linkage saddle 1052 and the well formation 20 is relatively small and is created by the spring of the accumulator 1082. The relatively small contact force results in a relatively small friction force between the linkage saddle 1052 and the well formation 20. This small friction force is easily overcome by the drive mechanism 18.

FIG. 11 shows the same hydraulic system that was described in relation to FIG. 10. The difference is that the drive mechanism 18 now applies an uphole force on the grip assembly 1012, which represents the power stroke of the tractor sonde. Also note that during the power stroke, the locking solenoid 1080 becomes energized. This prevents any hydraulic fluid communication between the second hydraulic cylinder 1079 and the accumulator 1082. (Note that in this manner, the locking solenoid 1080 acts in the same manner as the opening and locking device 51 of the above mechanical force amplifier embodiment.) As the first hydraulic cylinder piston 1075 is pulled uphole by the drive mechanism 18, fluid is pushed out of the uphole side of the piston 1075, through the check valve 1081 as indicated by solid arrows 1091. Since the solenoid valve 1080 is now closed and the other check valve 1083 is in the opposite direction, this fluid can only flow into the uphole side of the second hydraulic cylinder 1079. The fluid coming into the second hydraulic cylinder 1079 tends to drive the second hydraulic cylinder piston 1046 in the downhole direction as indicated by arrow 1095. The piston 1046 of the second hydraulic cylinder 1079 then applies a force on linkages 1034, forcing the linkage saddles 1052 into the well formation 20. If the piston area of the second hydraulic cylinder 1079 which is in contact with the fluid (i.e. the piston head) is made several times larger that the piston area of first hydraulic cylinder 1077 that is in contact with the fluid, then the force applied to the first hydraulic cylinder piston 1075 by the drive mechanism 18 is amplified several times when applied to the linkage 1034 (in one embodiment this force amplification is 10 times.) This force amplification ensures that the harder the drive mechanism 18 tries to displace the grip assembly 1012, the harder it grips the well formation 20. This force amplification can result in very large contact forces between the well formation 20 and linkage saddles 1052, which give rise to high frictional forces that anchor the grip assembly 1012 with respect to the well formation 20.

The above describes the return stroke as being in the downhole direction and the power stroke as being in the uphole direction. However, the hydraulic embodiment of FIGS. 10-11 is bi-directional, i.e., the state of the locking solenoid valve 1080 determines whether the tool is on its return stroke or whether it is on its power stroke. When the solenoid 1080 is de-energized, the linkages 1034 are flexible as free exchange of fluid occurs between the first hydraulic cylinder 1077 and the accumulator 1082. The tool is then on a return stroke. When the solenoid 1080 is energized, the linkages 34 become locked and the force amplification components get activated. This is the power stroke of the tool where the grip assembly 1012 becomes anchored to the well formation 20.

Although described herein with respect to a tractor tool system, the present invention is likewise to mechanical services tools, anchoring devices, or in any other devices where passive self-anchoring to the formation is beneficial. Hence, it is understood that a person knowledgeable of the field having the benefits of this disclosure would be able to construct a variety of tools that perform services that are not covered in detail here.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A downhole tractor comprising:

first and second grip assemblies each having a power stroke and a return stroke;

wherein the first grip assembly comprises a plurality of first engagement members, each for contacting a well formation;

wherein the second grip assembly comprises a plurality of second engagement member, each for contacting a well formation;

wherein the plurality of first engagement members each remain in contact with the well formation during both the power stroke and the return stroke of the first grip assembly; and wherein the plurality of second engagement members each remain in contact with the well formation during both the power stroke and the return stroke of the second grip assembly, wherein the plurality of first engagement members each have a first coefficient of friction with the well formation during the power stroke of the first grip assembly and a second coefficient of friction with the well formation during the return stroke of the first grip assembly, and wherein the first coefficient of friction is higher than the second coefficient of friction.

2. The downhole tractor of claim 1, wherein the plurality of first engagement members centralize the tractor during the return stroke of the first grip assembly, and wherein the plurality of second engagement members centralize the tractor during the return stroke of the second grip assembly.

3. The downhole tractor of claim 1, wherein the plurality of second engagement members each have a first coefficient of friction with the well formation during the power stroke of the second grip assembly and a second coefficient of friction with the well formation during the return stroke of the second grip assembly, and wherein the first coefficient of friction is higher than the second coefficient of friction.

4. The downhole tractor of claim 1, wherein each grip assembly comprises a geometry which is lockable by a locking device and wherein each grip assembly further comprises a force amplifier in force transmitting relation with the grip assembly, wherein the force amplifier transfers a force in a first direction to a much larger force in a second direction when the grip assembly is locked by the locking device.

5. The downhole tractor of claim 4, wherein the force amplifier comprises a saddle having a surface for contacting the well formation in area contact.

6. The downhole tractor of claim 5, wherein the grip assembly comprises a force transmission member in force transmitting relation to an inclined surface on the saddle to form said force transmitting relation between the force amplifier and said grip assembly, such that an interaction between the force transmission member and the inclined surface on the saddle causes said force transfer by the force amplifier.

7. The downhole tractor of claim 6, wherein said first direction is an axial direction with respect to the tool body, and wherein said second direction is a radial direction with respect to the tool body.

8. The downhole tractor of claim 7, wherein said force in said axial direction is a force applied to the grip assembly which causes the remainder of the tool to move in an opposite direction from said axial direction.

9. The downhole tractor of claim 5, wherein the saddle is anchored to the well formation during the power stroke, and the saddle is moveable relative to the well formation during the return stroke, and wherein the engagement members centralize the downhole tractor with respect to the well formation during the return stroke.

10. The downhole tractor of claim 5, wherein the surface of the saddle for contacting the well formation in area contact is harder than a remainder of the saddle.

11. The downhole tractor of claim 4, wherein the force amplifier is a mechanical force amplifier.

12. The downhole tractor of claim 4, wherein the force amplifier is a hydraulic force amplifier.

13. The downhole tractor of claim 12, wherein the hydraulic force amplifier comprises a first hydraulic cylinder in fluid communication with a second hydraulic cylinder, and wherein the first hydraulic cylinder has a higher fluid contact area than the second hydraulic cylinder.

14. The downhole tractor of claim 4, wherein the grip assembly comprises a plurality of linkages.

15. The downhole tractor of claim 4, wherein the downhole tractor is a tractor that is bi-directionally operable.

16. The downhole tractor of claim 4, wherein the well formation is an open hole formation.

* * * * *